US006315632B1

(12) United States Patent
Gibbons et al.

(10) Patent No.: US 6,315,632 B1
(45) Date of Patent: Nov. 13, 2001

(54) FORTUNE TELLING TOY

(76) Inventors: Gregory M. Gibbons; Gioia M. Gibbons, both of 315 Pleasantview Dr., Louisville, KY (US) 40206

( * ) Notice: Subject to any disclaimer, the term of this patent is extended or adjusted under 35 U.S.C. 154(b) by 0 days.

(21) Appl. No.: 09/439,618

(22) Filed: Nov. 12, 1999

(51) Int. Cl.[7] ..... A63H 33/00
(52) U.S. Cl. ..... 446/488; 273/161
(58) Field of Search ..... 446/487, 488; 156/217, 227; 273/161

(56) References Cited

U.S. PATENT DOCUMENTS

| | | | | |
|---|---|---|---|---|
| 1,547,967 | * | 7/1925 | Shilhan | 446/488 |
| 2,647,785 | * | 8/1953 | Casnati | 446/487 |
| 4,083,563 | * | 4/1978 | Drohomirecky et al. | 446/487 |
| 5,843,262 | * | 12/1998 | Rosendale et al. | 446/488 |

OTHER PUBLICATIONS

Marc Brown (Author) "Cootie Catcher" Internet Article Regarding Make Your Own Cootie Catcher http://www.pbs.org/wgbh/arthur/prunella/cootie/instructions.html (copy attached).

*The Cootie Catcher Book* by the Editors of Klutz Copyright 1997 Klutz Publishing Palo Alto, CA 94306 (Copies Attached).

*Cootie Catcher: Fantasy* Your Own Personal Fortuner Teller. Fold Your Own Fortune Tellers with Pre–Printed Messages. Found on Internet http:www.chronbooks.com/cgi–bin/adult/view. CGI? iSBN= 0811821374 (Copy of Web Page Attached).

*Cootie Catchers* Additional Web Site That Instructs How To Make Paper Fortune Teller http://www. howiedoit.com/~orion/cootiedocs/ (Copy of Web Page Attached).

* cited by examiner

*Primary Examiner*—Sam Rimell

(57) ABSTRACT

An improved folding fortune telling toy that is made to be held in the hands of a player for manipulation into specific positions. The toy is comprised of a body portion formed by folding and reinforcing a sheet of flexible material. The body is comprised of an inner surface and an outer surface. When folded and reinforced in the specified format, flexible outer flaps are integrally formed and allow the players fingers and thumb to slide under said flaps to manipulate the body portion between specific positions. The folding of the sheet also produces a plurality of flexible inner flaps that are integrally formed with the body portion and hingeably secured thereto and adapted to be disposed in a closed position in overlapping relationship with the body portion to an open position extending upwardly from the body portion, with each inner flap having a viewable outer surface marked with indicia and an inner surface. The inner flaps formed by the folding are sliced or divided so as to form a greater number of inner flaps. In the preferred embodiment, substantially translucent sheet material forms one or more card holder layers and is sewn or otherwise attached to the inner flap to form a pocket. Chance means or message cards are slid into the pocket between the card holder layer and the inner surface. When held in specific positions, a multiple of the inner flaps is revealed and the indicia marked on the viewable outer surface of said inner flaps is visible. These said indicia of the viewable surface of the inner flaps correlate to a specific inner flap that hingeably opens away from the body portion to reveal the inner surface and pocket(s) that hold the specific message cards.

16 Claims, 3 Drawing Sheets

FORTUNE TELLING TOY

BACKGROUND—FIELD OF INVENTION

This invention relates to a toy that is used to convey messages or fortunes to players.

BACKGROUND—DESCRIPTION OF PRIOR ART

It is common for children to be attracted to games or toys that convey secret messages. Toys that "tell fortunes" or predict some future event also have great attraction to children. A common school toy for elementary school children is a piece of plain square paper which is folded in such a way that it may be manipulated on the fingers to two distinct open positions. When in these open positions, the toy has flaps that have visible numbers. A player chooses one of these numbers. The flap with this number is opened to reveal a secret message or fortune.

This toy is often known among children as a "fortune teller", a "cootie catcher", "finger snapper", or some other name.

However, despite the popularity of these child-made toys, they suffer from several disadvantages:

(a) The toy is constructed of paper and its useful life is limited. The toy quickly becomes worn out or ripped during use.

(b) Being made of plain paper, its visual appeal is limited.

(c) The "fortunes" or "messages" are often written directly by the players, thus removing the element of surprise.

(d) Once viewed, the fortunes no longer have any surprise element because they are not replaceable.

(e) The messages are not interchangeable. Since the toy is constructed of a single piece of paper, a given message must always coincide with the same number on the flap. After playing with the toy, the players quickly learn which message corresponds to which number. Once the players know this, a significant part of the attraction is lost.

(f) The historical way in which the toy is made dictates that when a flap is opened to view a message the message immediately adjacent to it is also revealed. Thus, the players can see two of the messages with each turn. This further limits the amount of play that can occur before the messages in the toy are no longer secret or novel.

Several attempts have been made to overcome some of these disadvantages. U.S. Pat. No. 4,083,563 to Drohomirecky et al. discusses a folded fortune pouch game that is made of more durable material to extend its useful life. While successful in this way, this toy still suffers from several disadvantages:

(a) It is constructed such that when a flap is opened to view a message, the message immediately adjacent to it is also revealed.

(b) The messages are immediately visible when the flap is opened. There is no practical way to hide the message, if desired.

(c) It has separate message cards that are held to the toy using slits. This method relies on the stiffness of the card to stay in. It also relies on the card and the slits to be in good condition and properly sized. If either the card or slit is not in good condition or is improperly sized, the cards will fall out.

(d) This method of attaching message cards dictates that only one message corresponds to each numbered flap. Multiple message cards associated with a given flap are not practical.

(e) The message cards must be of a certain stiffness and shape. Soft or bendable material or unique shapes cannot be used.

(f) The message cards must be formed of material that is of a thickness that fits easily within the slits.

(g) The folds of the toy are not reinforced. This allows the toy to easily become misshapen.

Within the public domain there are articles which instruct how to make a folded fortune telling toy. More than one may be found on the Internet. In addition, *The Cootie Catcher Book* by the Editors of Klutz (1997 Klutz Publishing) discusses how to make such a toy and has several tear-out pages pre-printed with artistic designs and pre-printed messages. Although this presents some visual appeal versus a toy made by the players from plain paper, it suffers the disadvantages of being made of paper. This means it will have a limited life. It also has the lack of flexibility inherent with a single pre-printed sheet (i.e. the messages must always coincide with the same number on the flap so the players will quickly learn which message corresponds to which number).

OBJECTS AND ADVANTAGES

Accordingly, several objects and advantages of the present invention are to provide a folded fortune telling toy which:

(a) Allows the user to open a flap and view one message or fortune without having to expose to view the immediately adjacent message.

(b) Has messages which are replaceable.

(c) Has messages on cards that could be pre-printed so that there is an element of surprise for all users.

(d) Allows for simple interchanging of the messages so that a flap with a given number or symbol is not necessarily associated with a given message.

(e) Uses a method to hold message cards which protects the cards from falling out.

(f) Is more durable than toys made of the previously existing designs.

(g) Is constructed to be stiff enough to maintain its intended shape for play.

(h) Protects the message cards from rapid wear.

(i) Functions properly even if the message cards have damaged edges and corners.

(j) Allows for the use of multiple messages to be offered to the user in association with opening a single given flap.

(k) Provides a method for hiding the message or messages from immediate view when a given flap is opened.

(l) Allows that message cards can be made of very soft or very rigid material.

(m) Allows that message cards can be made of thin or thick material.

(n) Can be durably printed with colors or graphics that offer visual appeal.

Further objects and advantages of the invention will become apparent from a consideration of the ensuing drawings and description.

DRAWING FIGURES

FIG. 1 is a plan view illustrating the sheet of material from which the toy may be formed.

FIG. 2 is a plan view illustrating the second rectangle obtained by folding as in FIG 1.

FIG. 3 is a top plan view of the toy in the unfolded position.

FIG. 4 is a bottom plan view of the toy in the unfolded position.

FIG. 5 is a perspective view illustrating the toy in the unfolded position.

FIG. 6 is a perspective view of the toy in its folded position being held by the hands of a player.

FIG. 7 is a perspective view illustrating the manner in which the change of position of the toy occurs.

FIG. 8 is a perspective view with the toy having changed its position.

FIG. 9 is a fragmentary plan view of an alternative embodiment of the inner flaps.

FIG. 10 is a fragmentary plan view of an alternative embodiment of the pocket holding multiple message cards.

FIG. 11 is a perspective view of an alternative embodiment in which the toy is attached to a key chain.

FIG. 12 is a fragmentary plan view of an alternative embodiment of the inner flap utilizing independent pockets.

| Reference Numerals In Drawings | |
|---|---|
| 10 | toy |
| 12 | foldable sheet |
| 14 | corners (first rectangle) |
| 15 | arrow |
| 16 | second rectangle |
| 17 | stitch line |
| 18 | corners (second rectangle) |
| 19 | arrow |
| 20 | third rectangle |
| 21 | stitch line |
| 22 | body |
| 24 | inner surface |
| 26 | outer surface |
| 28 | panel |
| 30 | panel |
| 32 | upper end of panel |
| 34 | lower end of panel |
| 35 | spaced apart sides of panel |
| 36 | outer flaps |
| 38 | sides of outer flaps |
| 40 | inner end of outer flap |
| 42 | outer end of outer flap |
| 44 | fingers of player |
| 45 | hand of player |
| 46 | upper end of outer flap |
| 47 | thumbs of player |
| 50 | inner flaps |
| 51 | divider line |
| 52 | viewable outer surface of inner flap |
| 53 | card holder layer |
| 54 | inner surface of inner flap |
| 55 | message cards |
| 56 | corner of inner flap |
| 57 | pockets |
| 58 | independent pockets |
| 59 | tabs |
| 60 | arrow |
| 61 | stitch line |
| 62 | message |
| 75 | first indicia means |
| 76 | second indicia means |
| 80 | directional movement arrows |
| 81 | key chain |

SUMMARY

The present invention is a folded fortune telling toy which allows that only one numbered secret message or fortune flap is revealed at a time with message cards being held securely within a pocket. This pocket method allows that more than one message may be contained within the pocket corresponding to a given numbered flap. The toy is stitched for durability and to provide rigidity.

DESCRIPTION OF THE DRAWINGS

Referring to the drawings, a preferred embodiment of the present invention is illustrated in FIGS. 1 through 8. Alternative embodiments are depicted in FIGS. 9–12. The invention being a toy which is designed to be held in the hands of a player and manipulated into specific positions, ultimately revealing, by chance, only one of a plurality of secret messages or fortunes for another player. The messages are held within pockets under flaps of the toy.

The toy is formed of a foldable sheet 12, illustrated in FIG. 1, consisting of a rectangular sheet of material, which may be fabricated from plastic, nylon, canvas, or other foldable materials, having the four corners 14 of the sheet 12 being first folded backwardly, as indicated by arrow 15, to the center forming a second rectangle 16 of smaller dimensions. The edges of rectangle 16 are stitched or otherwise reinforced along the folds as shown in FIG. 2 by stitch line 17. This second rectangle 16 is illustrated in FIG. 2. The comers 18 of this smaller rectangle 16 are then folded inwardly to the center, in the direction of arrow 19, as illustrated in FIG. 2. This yields a third rectangle of still smaller dimensions 20, shown in FIG. 3. The edges of this third rectangle 20 are stitched or otherwise reinforced along the folds as shown by stitch line 21. The size of the toy may vary for children or adults by using a larger or smaller foldable sheet 12.

Figure 3:
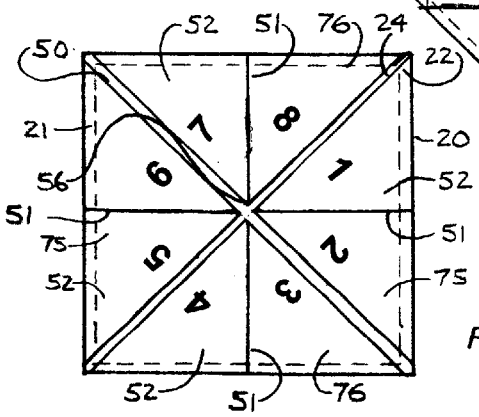
Figure 4:
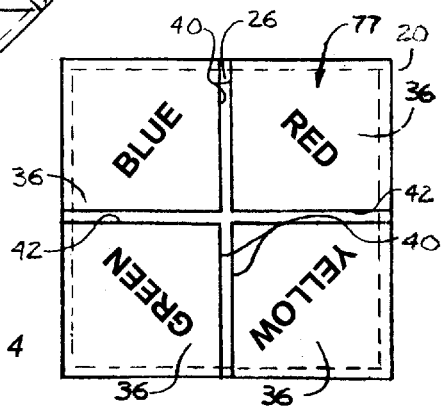
Figure 5:
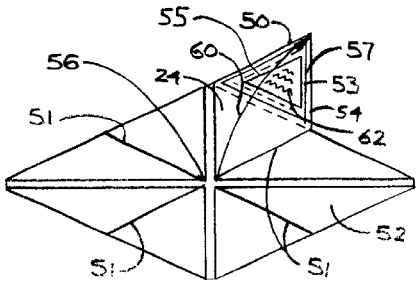
Figure 6:
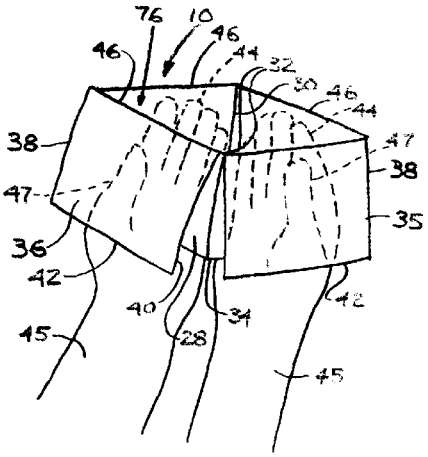

The third rectangle 20 forms a body portion of the flexible material having an inner surface 24 and an outer surface 26 so as to be foldable between a flat plane, as illustrated in FIGS. 3–5, into a pair of panels 28 and 30 in FIG. 6. Each panel includes oppositely disposed upper and lower ends 32 and 34, respectively, and spaced apart sides 35 intermediate the ends. The panels 28 and 30 are flexibly connected to each other along the lower end 34 and adapted to alter in configuration to the specific positions illustrated in FIGS. 6–8.

As shown in FIG. 6, a pair of flexible outer flaps 36 are integrally formed with each of the panels 28 and 30 on the outer surface 26, with each outer flap 36 being connected to the upper end 32 and one of the sides 38, such that each outer flap 36 has an inner end 40 and a bottom end 42 freely movable relative to its respective one of the panels 28 and 30 so that the fingers 44 of each hand 45 of the player may be interposed between each of the panels 28 and 30 and each of the flaps 36.

The upper end 46 and the sides 38 extend around the body portion 22 such that the panels 28 and 30 may be moved into various positions. The outer flaps 36 extend in substantially the same plane as the lower end 34 of each of the panels 28 and 30. Each flap 36 therefore has an upper end 46 which extends loosely over the upper end 32 of each panel 28 and 30, such that it is capable of movement relative thereto in the various positions illustrated in FIGS. 6–8. The flaps 36 are formed by following the folding of the sheet 12 illustrated in FIGS. 1–2.

Figure 1:
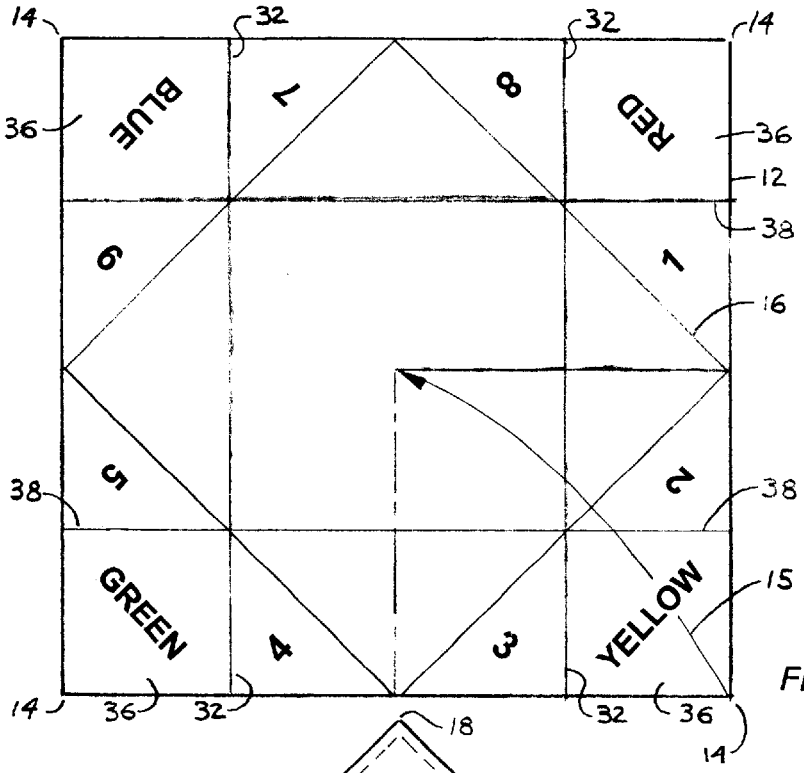
Figure 2:
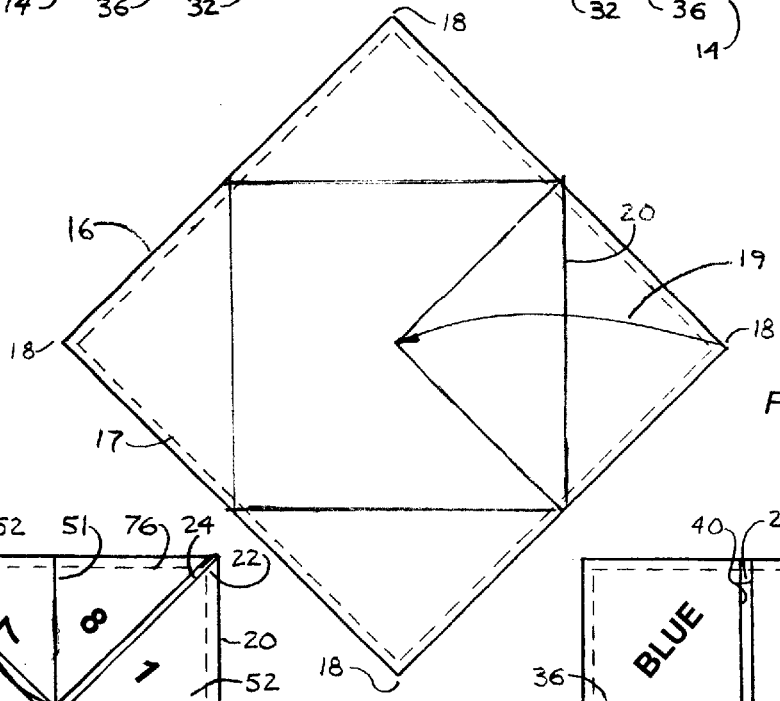

The toy 10 being formed in the manner set forth in FIGS. 1 and 2 develops the configuration such that the inner end 40 of the outer flaps 36 extend in vertically spaced relationship to each other, as illustrated in FIG. 4. In a similar manner, the bottom ends 42 of each flap 36 also extend in substantially parallel spaced relationship to each other in the flat position of the toy, also illustrated in FIG. 4.

FIG. 5 demonstrates that the folding of the sheet 12 also produces a plurality of flexible inner flaps 50 that are integrally formed with the body portion 22 and hingeably secured thereto and adapted to be disposed in a closed position in overlapping relationship with the body portion 22 to an open position extending upwardly from the body portion 22, with each inner flap 50 having a viewable outer surface 52 and an inner surface 54. The inner flap 50 is sliced or divided along divider line 51 so as to form a greater number of inner flaps 50. Substantially translucent sheet material forms one or more card holder layers 53 and is sewn or otherwise attached to each inner flap 50 to form pockets 57. Chance means or message cards 55 are slid into the pocket 57 between the card holder layer 53 and the inner surface 54.

Although the number of inner flaps 50 could vary, the embodiment of FIG. 5 illustrates eight inner flaps 50, each in the form of a triangle. One corner 56 of each triangle is disposed inwardly of one side of the body portion 22. Each inner flap 50, as illustrated by arrow 60 in FIG. 5, is readily moved to the open position, when the toy 10 is lying flat. In this open position, the card holder layer of the opened flap is now visible.

The message cards 55 of FIG. 5 may in fact be cards, chips, or other elements that can be secured in the pocket 57 formed between the card holder layer 53 and the inner flap 50. Each message card may have various messages, fortunes or symbols 62 thereon, or be in the blank form to be filled out by the players of the toy. The message card 55 may be removed when the toy 10 is in the position illustrated in FIG. 5. The message card 55 can be made of soft, pliable material or stiff material. The pockets 57 may be sized to accept very thin or rather thick message cards.

As shown in FIG. 3, the inner flaps 50 are provided with first indicia means 75 and second indicia means 76. The indicia means 75 and 76 are provided on the viewable outer surface 52. The first indicia means 75 are viewable when the panels 28 and 30 are positioned in one position and the second indicia means 76 are viewable when the panels 28 and 30 are positioned in another position by the manipulation of the fingers 44 and thumbs 47 of the player, as in FIG. 8.

As illustrated in FIG. 3, the first indicia means 75 is contained on oppositely disposed inner flaps 50 and includes the indicia information ONE, TWO on two flaps 50 and FIVE, SIX, on opposites flaps 50. The second indicia means 76 includes the information THREE, FOUR, on two flaps 50 and SEVEN, EIGHT on opposite flaps 50. The symbols used in first and second indicia 75 and 76 on the inner flaps 50 may vary and are not limited to any numbering sequence but may be symbols of any sort.

Third indicia means 77 is provided on each of the outer flaps 36. As illustrated in FIG. 4, the third indicia means 77 includes reference to the colors RED, BLUE, GREEN, and ORANGE. These third indicia means 77 are not limited to these or any other colors, but may be symbols of any sort.

Figure 8:
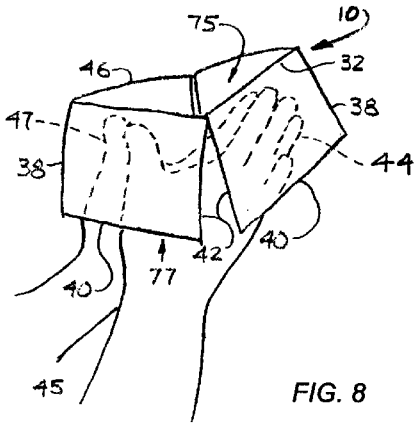

The toy 10 may be played with in various ways, but particularly the position may vary such that either the first indicia means 75 is viewable in the position illustrated in FIG. 8, or the second indicia means 76 is viewable when the toy 10 is held in the position illustrated in FIG. 6. As seen in FIG. 6, the fingers 44 of each hand are initially interposed between the outer flaps 36 and respective panels 28 or 30. The thumb 47 is placed between the other set of flaps 36 and the other panel 28, as illustrated in FIG. 6. In this position with the fingers 44 and thumbs 47 compressing slightly adjacent the ends 38, the second indicia means 76 will be viewable.

Figure 7:
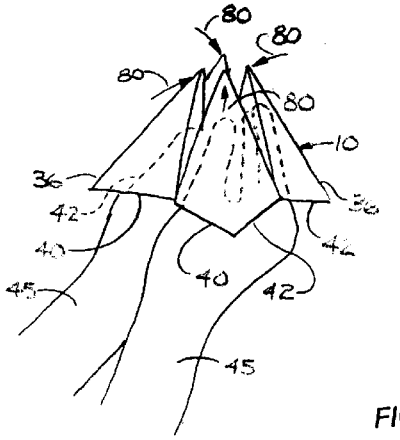

The transition step illustrated in FIG. 7 is accomplished by initially moving the respective thumb 47 and fingers 44 towards each other in the direction of arrows 80, such that the position illustrated in FIG. 8 is reached and the first indicia means 75 is viewable. As illustrated in FIG. 8, the hands 45 of the player approach a prayer position to obtain this arrangement. Movement from FIG. 6 to FIG. 8 is readily obtained by a user of the toy. In addition, movement from FIG. 8 to FIG. 6 is also easily obtained.

The rules of play permit the player to maneuver the toy such that looking down from the top one would see the written numbers of the first and second indicia means 75 and 76. The above steps illustrate the general movement of the toy such that it can be used as a fortune telling or message telling toy in conjunction with the message cards 55.

ADDITIONAL EMBODIMENTS

Figure 9:
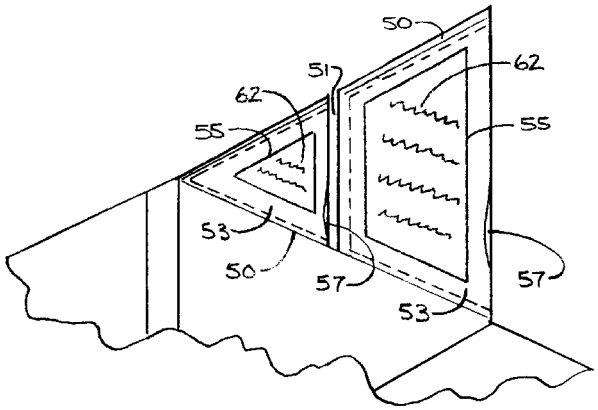

FIG. 9 illustrates an embodiment of the fortune teller toy in which the inner flap 50 is divided into several smaller inner flaps, each being capable of accommodating a correspondingly sized and shaped card holder layer 53 and additional message cards 55.

Figure 10:
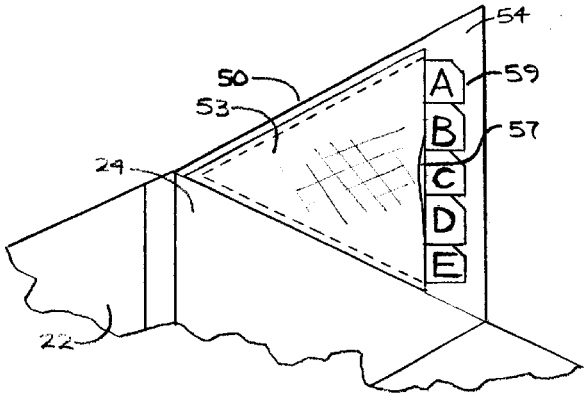

FIG. 10 illustrates an embodiment such that the card holder layer 53 may alternatively be constructed of opaque material so that the message card or cards are not immediately visible when the inner flap 50 is opened. This allows additional message cards to be contained in the pockets 57 of the toy. FIG. 10 shows five message cards 55 with tabs 59. However, any reasonable number of message cards could be placed in the pockets 57 and be easily removed individually by the players. The pockets 57 may be constructed of any material with a shape and size designed to accommodate the desired number of message cards 55. The tabs 59 have indicia that a player may call out in order to receive the message contained on a particular card. The indicia in FIG. 10 are A,B,C,D,E; however, symbols of any sort could be used.

Figure 11:
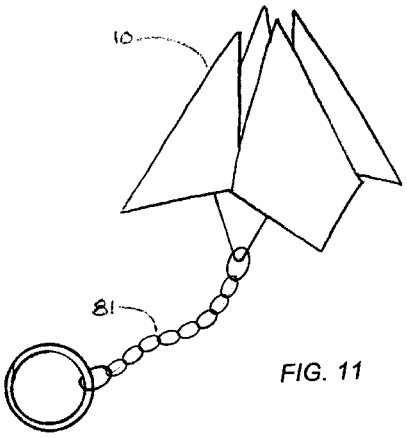

FIG. 11 illustrates an embodiment in which the toy 10 is attached to a key chain 81.

Figure 12:
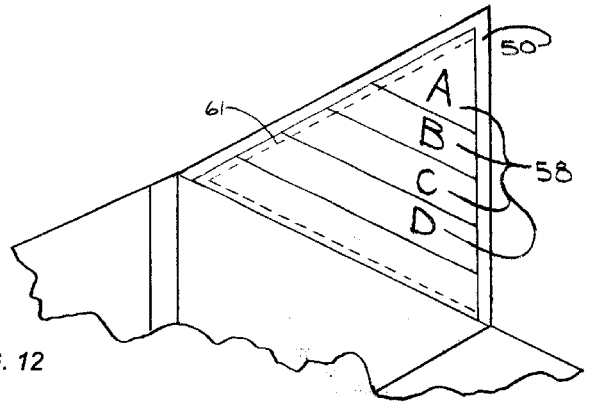

FIG. 12 illustrates an embodiment in which independent pockets 58 of sheet material are attached to each of the inner flaps 50. These independent pockets 58 are sewn or otherwise attached to the inner flap 50 along stitch line 61. This could utilize single or multiple independent pockets 58. The independent pockets 58 hold message cards 55 with indicia means. The indicia in FIG. 12 are A,B,C,D; however, symbols of any sort could be used.

ALTERNATIVE EMBODIMENTS

Further novel embodiments of the toy described herein are:

- the toy adapted such that the message cards 55 are edible or are made in such a fashion so as to have collectible appeal to players of the toy, such as a coin or trinket;
- the toy attached to a necklace, similar to the keychain embodiment of FIG. 11, to be worn around the neck of a player;
- the toy embedded with a motion activated sound chip which makes an audible noise as the toy is moved between the three positions indicated in FIGS. 9, 10, and 11.

Although the toy has been illustrated as being fabricated from a single sheet of material, it is appreciated that it may be fabricated from multiple sheets or otherwise manufactured to achieve the same result.

CONCLUSION, RAMIFICATIONS, AND SCOPE

Thus the reader will see that this invention provides substantial improvements unavailable in early designs of toys in its class:

This invention allows the user to open a flap and view one message or fortune without having to expose to view the immediately adjacent message. This feature means only the intended message is exposed, thus expanding the element of surprise for players.

The messages are easily replaceable so that the toy can be renewed with fresh messages for the players.

Allows for simple interchanging of the messages so that a flap with a given number or symbol is not necessarily associated with a given message. This means that a player will not quickly learn that a certain message is associated with a flap of a certain number. This also extends the element of surprise.

The method of placing the message cards in a pocket protects the cards from falling out during play and protects the message cards from easily becoming damaged. However, should the message cards become frayed or worn, they can still be securely held in the pocket.

This invention yields a toy that is more durable than toys made of previously existing designs.

The pocket design for holding the message cards allows for the use of multiple messages to be offered to the user in association with opening a single given flap. This means the toy may contain a far greater number of messages than previous designs in its class. A greater number of messages means greater fun for the players.

When used with an opaque card holder layer, the message (s) may be hidden from immediate view when a given flap is opened. Therefore, if the flap is unintentionally opened, the element of surprise is not dissipated.

The message cards can be made of very soft or very rigid material and still be held within the pockets.

The message cards can be made of thin or thick material and still be held within the pockets.

Although a preferred embodiment and several alternative embodiments of the invention have been described in detail herein with reference to the accompanying drawings, it is to be understood that the invention is not limited to these precise embodiments and that various changes and modifications may be effected therein without departing from the scope or spirit of the invention.

We claim:

1. A toy made to be held in the hands of a player for manipulation into specific positions, said toy comprising:

a. a body portion of a flexible material having an inner surface and an outer surface, said body portion being foldable between a flat plane and into a pair of panels, b. said panels each including oppositely disposed upper and lower ends and spaced apart sides inter-mediate said ends, said panels flexibly connected to each other along said lower end, c. a pair of flexible outer flaps integrally formed with each of said panels on said outer surface, each said outer flap being connected to said upper end and one of said sides, each said outer flap having an inner end and a bottom end freely movable relative to its respective one of said panels, such that the fingers of each hand of the player may be interposed between each of said panels and each of said flaps, d. a plurality of flexible inner flaps integrally formed with said body portion and hingeably secured thereto and adapted to be disposed in a dosed position in overlapping relationship with said body portion to an open position extending upwardly from said body portion, e. each said inner flap having a viewable outer surface and an inner surface, f. a plurality of card holder layers adhered to each of said inner flaps to form a pocket, g. message cards held within said pockets, such that said message cards fit within said pocket and are removable, h. first and second indicia means on said inner flaps on each said viewable outer surface, i. each said inner flap and said pocket adapted to be disposed in a closed or open position independent of other said inner flaps, and j. said first indicia means being viewable when said panels are positioned in one position and said second indicia means being viewable when said panels are positioned in another position by manipulation of the fingers of the player.

2. A toy as in claim 1, wherein said body portion is stitched to provide rigidity.

3. A toy as in claim 2, wherein said inner flaps are adapted such that only one of said pockets and message card is viewable when a given said inner flap is disposed in the open position.

4. A toy as in claim 2, that has at least 8 said inner flaps and corresponding said pockets.

5. A toy as in claim 4, that has one said message card held within each of said pockets.

6. A toy as in claim 4, that has a plurality of message cards within said pockets, each of said message cards removable independently from adjacent said message cards.

7. A toy as in claim 6, wherein said message cards have tabs aligned such that said tab of one said message card aligns in a vertically different plane from said tab of adjacent said message cards.

8. A toy as in claim 1, wherein said card holder layers are formed of independent pockets that are adhered to each of said inner flaps.

9. A toy as in claim 4, wherein each said inner flap has a plurality of cardholder layers.

10. A toy as in claim 4, wherein each said inner flap has a single said card holder layer and a plurality of said message cards, each of said message cards removable independently from adjacent said message cards.

11. A toy as in claim 4, wherein each said inner flap has a plurality of said card holder layers and a plurality of said message cards, each of said message cards removable independently from adjacent said message cards.

12. A toy as in claim 1, wherein the card holder layer is substantially translucent.

13. A toy as in claim 1, wherein the card holder layer is opaque.

14. A toy as in claim 1, and third indicia means on each of said outer flaps.

15. A toy as in claim 1, wherein said flexible material is fabric with plastic backing.

16. A toy as in claim 1, wherein said message cards are edible by a human.

* * * * *